US008317018B2

(12) United States Patent
Florentz et al.

(10) Patent No.: US 8,317,018 B2
(45) Date of Patent: Nov. 27, 2012

(54) CIGAR PACKAGE

(75) Inventors: Joyce Florentz, New York, NY (US); Kevin Joyce, New York, NY (US)

(73) Assignee: Marayna LLC, New York, NY (US)

( * ) Notice: Subject to any disclaimer, the term of this patent is extended or adjusted under 35 U.S.C. 154(b) by 0 days.

(21) Appl. No.: 12/861,661

(22) Filed: Aug. 23, 2010

(65) Prior Publication Data

US 2012/0043233 A1 Feb. 23, 2012

(51) Int. Cl.
*B65D 85/12* (2006.01)

(52) U.S. Cl. ..... 206/242; 206/486

(58) Field of Classification Search ..... 206/242, 206/244, 236, 256, 485, 486, 490; 229/160.1; 131/241, 280, 283, 360
See application file for complete search history.

(56) References Cited

U.S. PATENT DOCUMENTS

| | | | | |
|---|---|---|---|---|
| 1,512,100 | A * | 10/1924 | Hough | 206/251 |
| 1,759,079 | A | 5/1930 | Ernest et al. | |
| 2,100,035 | A | 11/1937 | Merrick | |
| 2,828,008 | A | 3/1958 | Fryburger | |
| 3,144,343 | A | 8/1964 | Fritsche | |
| 3,372,812 | A | 3/1968 | Parcels | |
| 3,439,798 | A | 4/1969 | James | |
| 3,628,671 | A | 12/1971 | Schweickart | |
| 3,682,351 | A | 8/1972 | De Putter | |
| 3,802,555 | A | 4/1974 | Grasty et al. | |
| 4,516,677 | A | 5/1985 | Rowland et al. | |
| 4,645,079 | A | 2/1987 | Hill | |
| 5,144,897 | A | 9/1992 | Avery | |
| 5,161,703 | A | 11/1992 | Patton | |
| 5,261,535 | A | 11/1993 | Light et al. | |
| 5,320,223 | A | 6/1994 | Allen | |
| 5,335,770 | A | 9/1994 | Baker et al. | |
| 5,377,855 | A | 1/1995 | Cook et al. | |
| 5,409,560 | A | 4/1995 | Hammer et al. | |
| 5,647,284 | A | 7/1997 | Frysinger et al. | |
| 5,722,557 | A * | 3/1998 | Smith | 220/476 |
| 5,749,461 | A * | 5/1998 | Guzman | 206/245 |
| 6,036,024 | A | 3/2000 | Seidler | |
| 6,148,827 | A * | 11/2000 | Hollenstein | 131/241 |
| 6,311,842 | B1 | 11/2001 | Minerich et al. | |
| 6,615,996 | B1 | 9/2003 | Ivey | |
| 6,685,036 | B2 | 2/2004 | De Jenlis et al. | |
| 6,935,505 | B1 * | 8/2005 | Nash et al. | 206/562 |
| 7,237,684 | B2 | 7/2007 | Kanachowski | |
| 7,556,152 | B2 | 7/2009 | Lechelle | |
| 8,152,002 | B2 | 4/2012 | Bibert Guasch | |
| 2004/0000504 | A1 | 1/2004 | Wang | |
| 2004/0195191 | A1 | 10/2004 | Carlin et al. | |
| 2004/0238398 | A1 | 12/2004 | Wilson | |
| 2005/0016942 | A1 | 1/2005 | Lobe | |
| 2009/0188833 | A1 * | 7/2009 | Klos | 206/583 |
| 2010/0065458 | A1 | 3/2010 | Myers et al. | |

FOREIGN PATENT DOCUMENTS

DE 7909669 6/1988

(Continued)

*Primary Examiner* — Luan K Bui
(74) *Attorney, Agent, or Firm* — Leason Ellis LLP

(57) ABSTRACT

A packing system for cigars including a cigar box and at least one support. The flat support is sized slightly larger than the distance between a pair of walls of the cigar box so that the support is compressed into an arch shape that is maintained by the walls when inserted into the cigar box. The support includes a plurality of elongate holes that define a plurality of collars. The cigars are seated by the collars and restrict the movement of the cigars. The support also provides a pleasing display for the cigars. In a more particular arrangement, one or more such supports include tabs that engage the cigars of a straight body type and restrict movement of the cigars.

16 Claims, 7 Drawing Sheets

FOREIGN PATENT DOCUMENTS

| | | |
|---|---|---|
| DE | 8711170 | 9/1988 |
| EP | 0324699 | 7/1989 |
| FR | 2350273 | 12/1977 |
| FR | 0020227 | 12/1980 |
| FR | 2622420 | 5/1989 |
| FR | 2755098 | 4/1998 |
| GB | 666791 | 2/1952 |
| GB | 773736 | 5/1957 |
| WO | WO 03/020592 | 3/2003 |

* cited by examiner

CIGAR PACKAGE

FIELD OF THE INVENTION

This invention relates to the packing of cigars, and, more particularly, to a box and a support disposed within the box for supporting a plurality of cigars.

BACKGROUND OF THE INVENTION

In the cigar industry, cigars are typically packaged in wood boxes. One problem is that the wrapping around cigars is delicate and can become damaged either by rubbing against the cigar box or other cigars in the box. On solution to this problem is to place the cigars in individual plastic sleeves or other individual cigar sleeves or tubes.

Providing individual sleeves or tubes is not desirable because the plastic sleeves are generally not recyclable and individual packing of cigars is both expensive and not environmentally friendly. An improvement in the art, as provided by the disclosed invention, is a support system wherein the supports can be made from flat sheet material that can be recyclable. The supports are automatically supported by a cigar box and restrict movement of the cigars within the cigar box.

SUMMARY OF THE INVENTION

According to one aspect of the invention, a cigar package for seating a plurality of elongate cigars includes a box having an interior defined by a bottom wall and sidewalls, including a first set of sidewalls spaced by a distance d. A support that has two sides spaced by a distance D that, when disposed within the box, engage the first set of sidewalls. The support includes a plurality of elongate holes having ends. The support assumes an arch when disposed in the box. The support includes pairs of spaced collars that are defined by the ends of each of the elongate holes and that are sized to seat end sections of the cigars.

In a more particular, optional arrangement, the support has an upper portion and a lower portion, and the plurality of elongate holes are defined in each of the upper and lower portions of the support. The upper portion of such a support assumes a concave arch and the lower portion of the support assumes a convex arch when disposed in the box.

In a further particular, possible arrangement, the support includes a first fold that defines the upper and lower portions.

In yet further optional arrangements, the upper portion of the support includes a flap defined by a second fold. The flap overlaps an area of the lower portion and is sized to seat an edge of the lower portion of the support.

According to further, more particular, optional arrangements, the cigar package includes first and second supports disposed within the box, each support having a first portion and two sides spaced by the distance D that engage a first set of sidewalls of the box. The first portion of each support defines a plurality of elongate holes having ends and the first portion of each support assumes a concave arch when disposed in the box. The second support further includes a second portion defining a plurality of elongate holes having ends. The second portion assumes a convex arch when disposed in the box. The first and second supports include a plurality of pairs of spaced collars, each pair of collars being defined by the ends of each of the elongate holes and are sized to seat the end sections of the cigars.

In yet a further, possible arrangement, a first set of cigars is received by the collars of the first portion of the first support.

The second support is positioned relative to the first support so that the collars of the second portion of the second support engage the first set of cigars. A second set of cigars is received by the collars of the first portion of the second support.

According to further, optional arrangements, a support is disposed within the box that has an upper and lower portion defined by a fold and has two sides spaced by the distance D that engage the first set of sidewalls of the box. The upper and lower portions of such a support each define a plurality of elongate holes having ends. The upper portion assumes a concave arch and the lower portion assumes a convex arch when the support is disposed in the box. The support includes a plurality of tabs, each tab extending from the upper and lower portions of the support at each end of the elongate holes and the tabs are sized to seat end sections of the cigars.

In a more particular, possible aspect, the tabs have first, second, and third members defined by first, second, and third folds, with the second member being sized to seat the end sections of the cigars.

In a further, more particular, optional aspect, the third member of each tab defines a slit. The slits of the third members of the tabs extending from the upper portion of the support engage corresponding slits of the third members of the tabs extending from the lower portion of the support.

Other aspects, features and advantages of the invention will be apparent in view of the accompanying description of certain embodiments thereof when considered in connection with the accompanying drawing figures.

DETAILED DESCRIPTION OF THE INVENTION

Figure 1A:
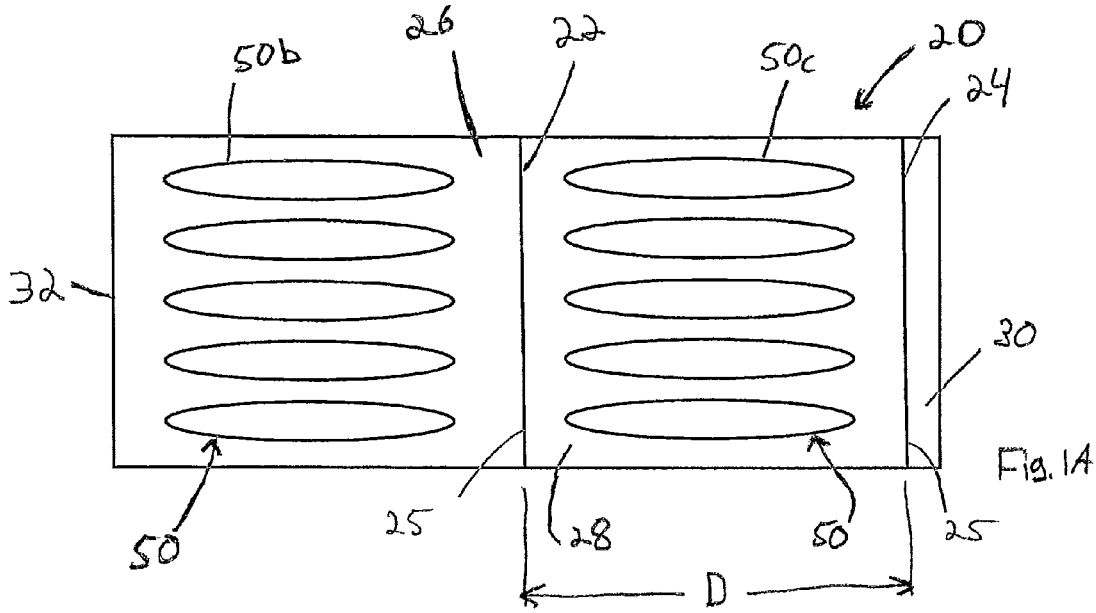
FIG. 1A is a top view of a support in a flat form according to one embodiment of the invention.
Figure 1B:
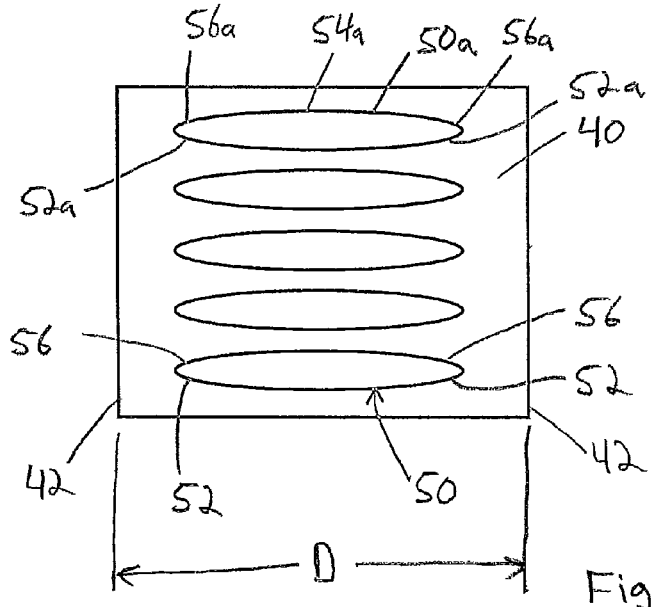
FIG. 1B is a top view of another support in a flat form.
Figure 2:
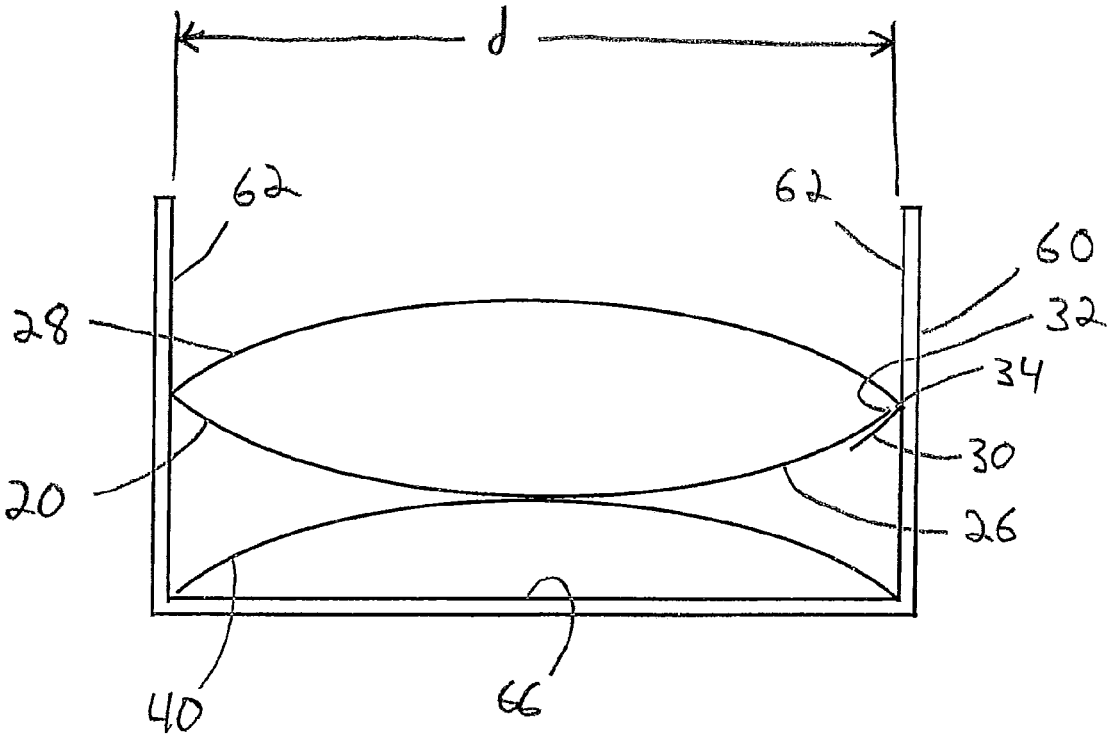
FIG. 2 is a side cross-sectional view of the supports of FIGS. 1A and 1B disposed in a cigar box.

Referring to FIGS. 1A and 1B, the basic construction of the supports 20 and 40 are described. In one embodiment, the supports 20 and 40 are formed from paper card stock. A plurality of elongate holes 50 are formed in the supports 20 and 40. Support 20 is further provided with fold lines 22 and 24. FIGS. 1A and 1B illustrate the supports 20 and 40 in flat form. FIG. 2 illustrates supports 20 and 40 disposed within a cigar box 60 with support 20 folded along fold lines 22 and 24. Referring to FIGS. 1A, 1B, and 2, support 20 is folded along the first fold line 22 so that a lower portion 26 of the support 20 is folded under an upper portion 28 of the support

20. The support 20 is folded along the second fold line 24 so that a flap 30 overlaps an area of the lower portion 26 of the support. An edge 32 of the support is seated in an angled corner 34 formed along the second fold line 24 between the upper portion 28 and the flap 30 of the support 20. The seating of the edge 32 in the angled corner 34 and the overlap of the flap 30 assists in maintaining the support 20 in its folded configuration disposed within cigar box 60, as shown in FIG. 2.

The cigar box 60 has opposing sidewalls 62 and 64, a bottom wall 66. The cigar box 60 typically also includes a lid or cover 68 (FIG. 3C). The support 40 is sized so that the distance "D" between two sides 42 of support 40 is greater than the distance "d" between the sidewalls 62 of the cigar box 60. Since the support 40 is sized larger than the cigar box 60, the support 40 compresses in order to be seated between the sidewalls 62 of the cigar box 60. The compression causes the support 40 to bow and assume an arch shape. As can be seen in FIG. 2, the underside of the support 40 (facing the bottom wall 66) assumes a concave arch shape when it is disposed within the cigar box 60. The sidewalls 62 of the cigar box 60 maintain a compressive force on the support 40 that maintains the support 40 in its arched configuration. The support 40 is also supported by the bottom wall 66 of the cigar box.

When the support 20 is folded along fold lines 22 and 24, the fold lines define two sides 25 of support 20. Similar to support 40, support 20 is sized so that the distance "D" between two sides 25 of support 20 is greater than the distance "d" between the sidewalls 62 of the cigar box 60. In similar fashion, since the distance "D" is greater that distance "d", support 20 compresses and bows to assume an arch shape. As can be seen in FIG. 2, the upper portion 28 of the support 20 assumes a concave arch shape and the lower portion 26 of the support 20 assumes a convex arch shape (relative to the bottom wall 66). The sidewalls 62 of the cigar box 60 maintain a compressive force on the support 20 that maintains the support 20 in its arched configuration. The support 20 is supported by the sidewalls 62 of the cigar box 60 and also rests on support 40. Thus, support 40 assists to maintain support 20 in its vertical position within the box 60.

Figure 3A:
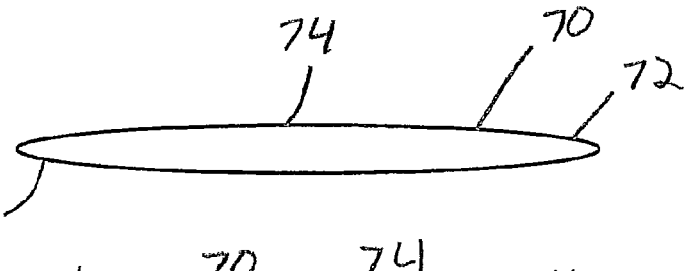
FIG. 3A is a side view of a cigar to be used with the packaging system of the invention.
Figure 3B:
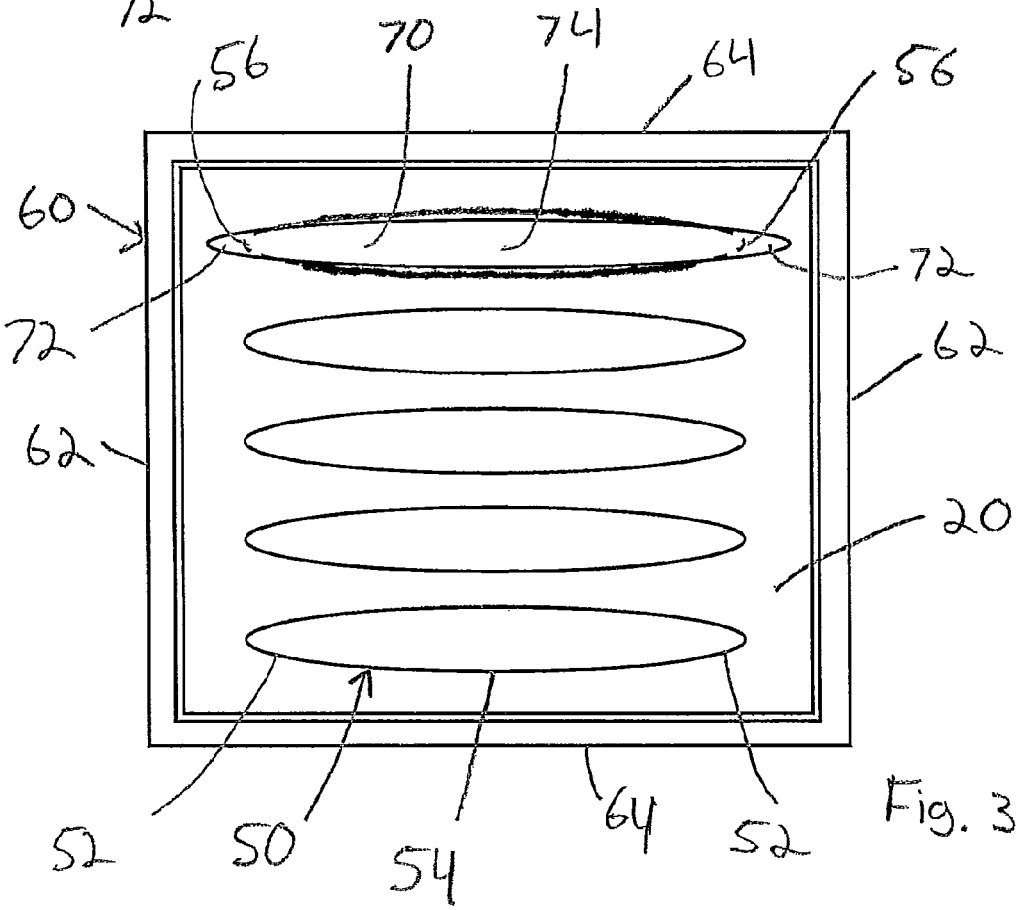
FIG. 3B is a top view of a support disposed with a box and a cigar supported by the support.
Figure 3C:
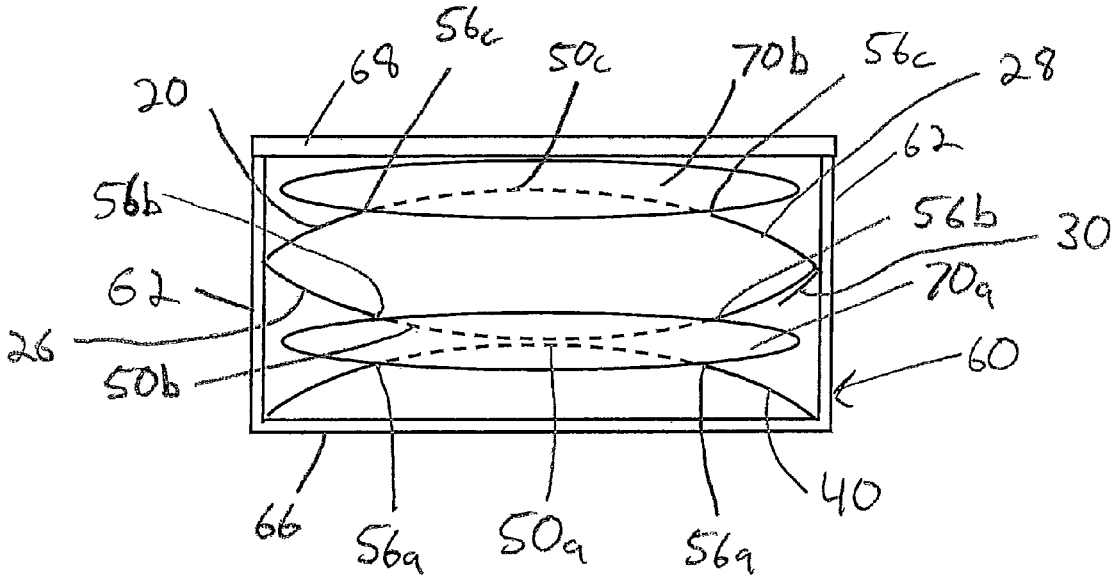
FIG. 3C is a side cross-sectional view of the supports of FIGS. 1A and 1B disposed in a box with cigars supported by the supports.

Referring now to FIGS. 3A, 3B, and 3C, the receiving of a cigar 70 by the supports will be described. The cigar 70 has end sections 72 and an intermediate section 74. The cigar 70 is a "fat body" type, or commonly referred to as a "perfecto" type cigar. The intermediate section 74 is wider than the end sections 72. The elongate holes 50 have ends 52 and a middle 54. The middle 54 of the holes are wider than the ends 52.

The ends 52 of the holes 50 define collars 56 in the supports 20 and 40. When the supports 20 and 40 are disposed within the cigar box 60 and assume an arch shape, the collars 56 rotate according to the curve of the arch and present a seat for the ends sections 72 of the cigars. The collars 56 are generally U-shaped and are sized to seat the end sections 72 of the cigar 70. FIG. 3B illustrates a cigar 70 seated by a pair collars 56 defined by one of the elongate holes 50. The collars 56 are shown in dashed lines.

Referring now to FIG. 3C, a first cigar 70*a* is seated by a pair of collars 56*a* defined by an elongate hole 50*a* in support 40. (A reference numeral with a sub-letter is used throughout to refer to a particular element common to several components. Reference numeral without a sub-letter refers to the element in general.) The elongate holes 50*a* and 50*b* in supports 40 and 20, respectively, are aligned such that cigar 70*a* is also seated by a pair of collars 56*b* defined by an elongate hole 50*b* in lower portion 26 of support 20. Thus, the cigars 70*a* are seated by collars 56*a* from below and seated by collars 56*b* from above. A second cigar 70*b* is seated by a pair of collars 56*c* defined by an elongate hole 50*c* in upper portion 28 of support 20. The perimeters of the elongate holes 50*a*, 50*b*, and 50*c* are shown in dashed lines.

As can be seen in FIGS. 3B and 3C, the elongate holes 50 are sized such that the middles 54 of the holes 50 are slightly wider than the intermediate sections 74 of the cigars so that the intermediate sections 74 are partially recessed into the holes 50. Since the intermediate sections 74 of the cigars 70 are recessed into the elongate holes 50, the supports 20 and 40 restrict side-to-side movement of the cigars. The supports 20 and 40 are sized so that sidewalls 64 of the cigar box 60 prevent side-to-side movement of the supports.

The collars 56 are sized such that they are narrower than the intermediate sections 74 of the cigars. Thus, the intermediate portions 74 cannot slide past the collars 56 on either side of the cigar 70 and the cigar is thereby restricted from end-to-end movement. In addition to being restricted from side-to-side and end-to-end movement, cigars 70*a* are restricted from up and down movement because they are seated between support 20 and 40 and are seated by collars 56*a* from below and seated by collars 56*b* from above. Cigars 70*b* are restricted from up and down movement because they are seated from below by collars 56*c* of the upper portion 28 of support 20 and are restricted from upward movement by lid 68 of the cigar box 60. Thus, the cigar box 60, supports 20 and 40, the collars 56, and the cigars 70 form an interlocking structure that is self supporting and securely restricts movement of the cigars 70 to protect them during transport and handling.

An advantage of the design of the supports 20 and 40 is that the packing of the cigars 70 into the cigar box 60 is simple and efficient. A flat support 40 is first placed into the box 60, which automatically causes the support 40 to assume an arch shaped because of the difference of dimensions between the support 40 and the sidewalls 62 of the box 60 and the rigidity of the support itself. The shape and position of the arched support 40 is automatically maintained by the sidewalls 62 and bottom wall 66 of the box 60. A first row of cigars 70*a* is placed into each of the elongate holes 50 in the support 40. The lower portion 26 of support 20 is folded under the upper portion 28 along fold line 22 and flap 30 is folded to overlap an area of the lower portion 26. The support 20 is placed into the box 60, which automatically causes the upper and lower portions 28, 26 of support 20 to assume concave and convex arch shapes, respectively, because of the difference in dimensions between the support 20 and the sidewalls 62 of the box 60 and the rigidity of the support itself. The support 20 is inserted into the box 60 until the lower portion 26 of support 20 contacts support 40 and collars 56*b* of the lower portion 26 engage the cigars 70*a*. The shape and position of the arched support 20 is automatically maintained by the sidewalls 62 of the box 60, support 40, and the flap 30. A second row of cigars 70*b* is placed into each of the elongate holes 50*c* in the upper portion 28 of support 20. Then, lid 68 is placed on the box 60 to close it.

The design of the supports provides significant advantages in that it can be formed from a single sheet of material. The holes 50 can be pre-punched using conventional punch machines and the fold lines 22 and 24 can be pre-creased, scored, or marked on the material. Thus, the supports can be manufactured efficiently and economically. In addition, the flat sheet material of the two supports 20 and 40 accommodates printing. Therefore, advertisements, trademarks, logos, information about the cigars, or other indicia can be printed of the sheet material, which can be paper card stock, for example. Further, the supports can be shipped flat and tightly packed in a shipping package, thereby reducing shipping costs and environmental impact associated with transporting a bulky item. The shape of support 40 is maintained by the cigar box 60 and the shape of support 20 is maintained by the folds 22 and 24 and the cigar box 60. No glue or adhesive is required, though it may be optionally used.

When the packed cigar box 60 arrives at its destination (e.g., a cigar shop or end user), the cigar box is opened by removing the lid 68, which can be pivotally attached to the box 60 or be completely removable. The second row of cigars 70*b* are held by the upper portion 28 of support 20 and are presented for selection and removal from the elongate holes 50*c* of the support 20. As can be seen in FIG. 3C, the upper portion 28 of support 20 curves away from the cigars 70*b*. The cigars 70*b* are also spaced from adjacent cigars due to the spacing between each of the elongate holes 50, as can be seen in FIG. 3B. This creates the appearance that the cigars 70*b* are floating in the box 60. This produces a pleasing visual display for the cigars and is designed to enhance their appeal to a consumer. After all the cigars 70*b* are removed from the elongate holes 50*c* of the upper portion 28 of support 20, the support 20 is removed from the box 60 thereby revealing cigars 70*a* supported by support 40. Similarly, these cigars 70*a* have the appearance of floating in the box creating visual appeal to the consumer. Once all the cigars 70*a* have been removed, support 40 can be removed from the box 60. Supports 20 and 40 are preferably made from a recyclable and/or biodegradable material, such as paper card stock, and the paper card stock is itself preferably made from recycled material. Thus, the supports are further environmentally friendly in that they can be fully recyclable.

Figure 4A:
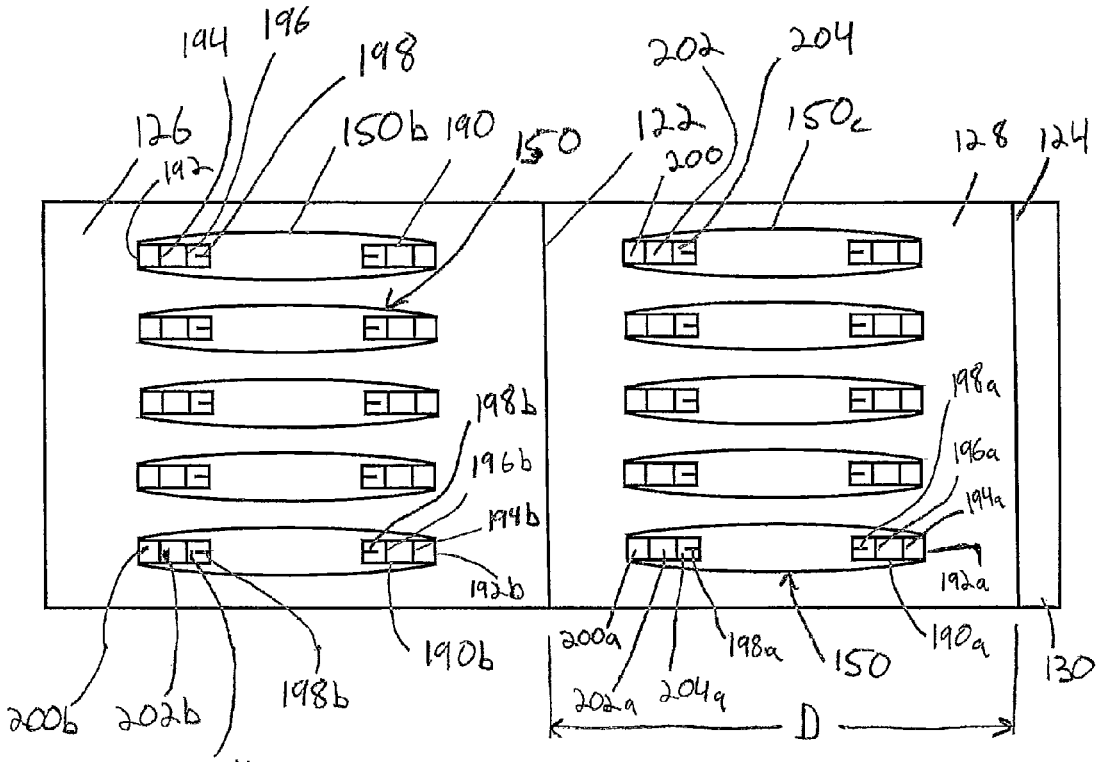
FIG. 4A is a top view of a support in a flat form according to another embodiment of the invention.
Figure 4B:
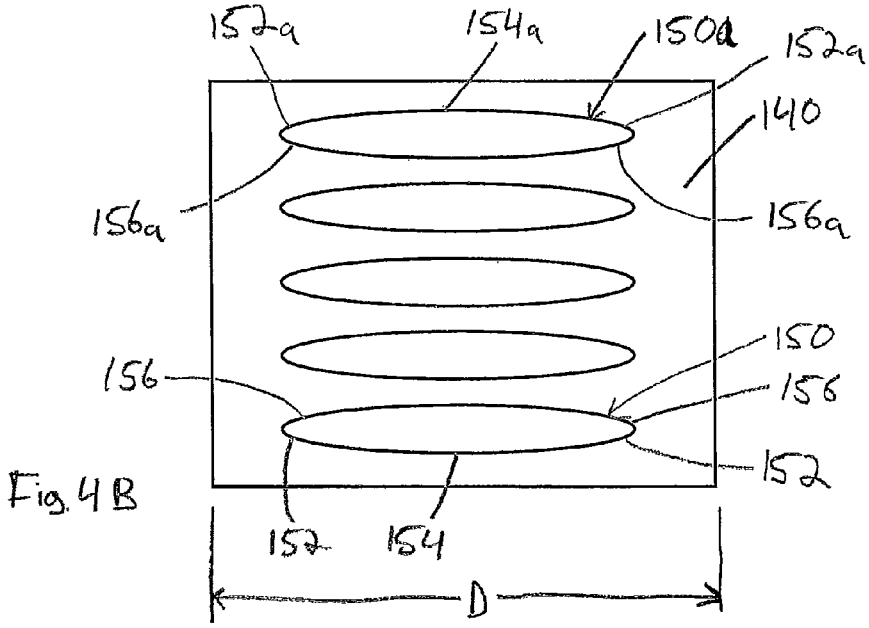
FIG. 4B is a top view of another support in a flat form.
Figure 5:
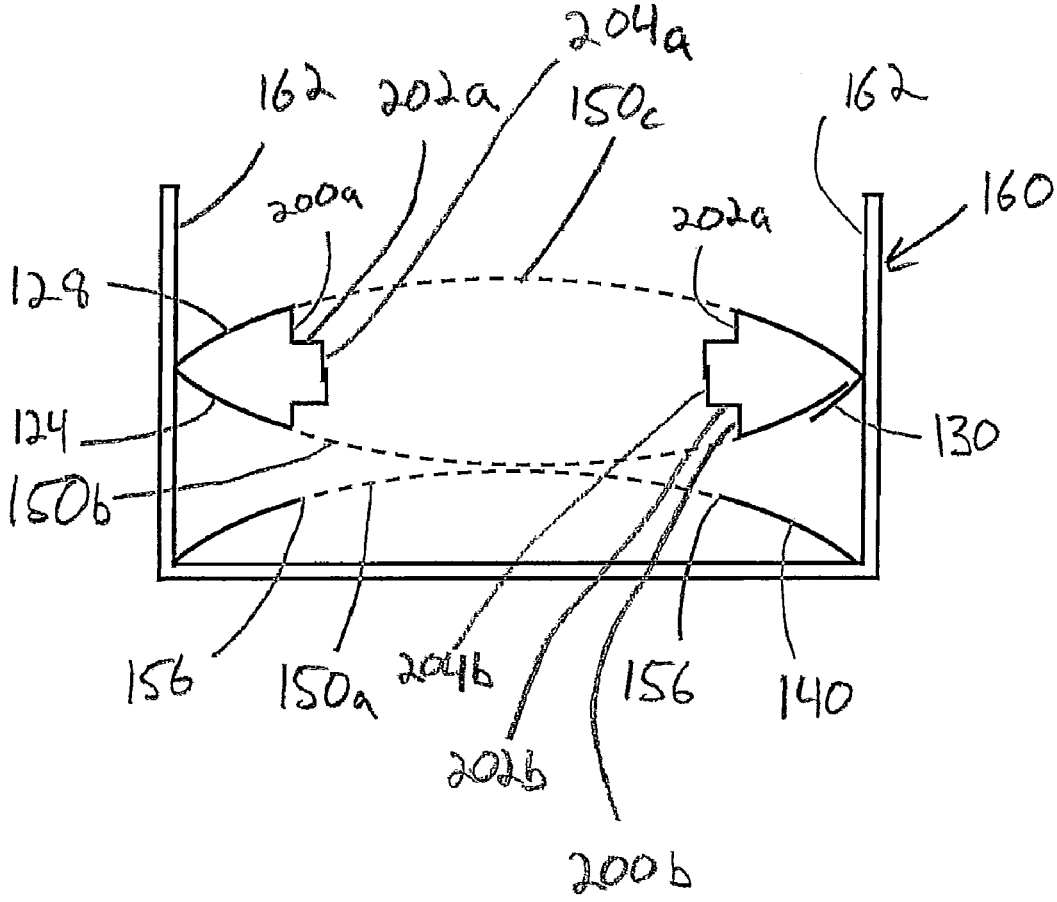
FIG. 5 is a side cross-sectional view of the supports of FIGS. 4A and 4B disposed in a cigar box.

FIG. 4 illustrates another embodiment that includes supports 120 and 140 that are similar to supports 20 and 40. One of the differences between the supports is that support 120 is provided with tabs 190 that extend from the support 120 into the elongate holes 150*b* and 150*c*. The tabs 190 are provided with three fold lines 192, 194, and 196 and a slit 198. The tabs are folded along the fold lines in order to define three panels 200, 202, and 204. As can be seen in FIG. 5, the tabs 190*a* of the upper portion 128 are folded along fold lines 192*a*, 194*a*, and 196*a* so that panel 200*a* extends downwardly in a generally vertical direction, panel 202*a* extends in a generally horizontal direction, and panel 204*a* extends downwardly in a generally vertical direction. The tabs 190*b* of the lower portion 126 are folded in a corresponding manner so that the panels 204*a* and 204*b* of corresponding tabs 190*a* and 190*b* of the upper and lower portions 128 and 126 can engage one another. Accordingly, the tabs 190*b* of the lower portion 126 are folded along fold lines 192*b*, 194*b*, and 196*b* so that panel 200*b* extends upwardly in a generally vertical direction, panel 202*b* extends in a generally horizontal direction, and panel 204*b* extends upwardly in a generally vertical direction. Panel 204*b* of tab 190*b* is inserted into slit 198*a* of tab 190*a* and panel 204*a* of tab 190*a* is inserted into slit 198*b* of tab 190*b*. Thus, the tabs 190*a* and 190*b* engage each other by respective slits 198*a* and 198*b* of their respective panels 204*a* and 204*b*. Similar to support 20, no glue or adhesive is required to form support 120 and joint the tabs 190*a* and 190*b*. The support 120 can be formed by punch cutting the elongate holes 150 and leaving behind the tabs 190. The fold lines can be printed onto the material to indicate where the support 120 is to be folded, or they can be pre-creased or scored during manufacturing. Then the support 120 can be simply folded into its in use configuration, as shown in FIG. 5

Figure 6A:
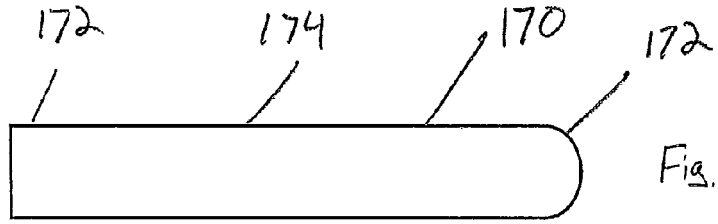
FIG. 6A is a side view of a cigar to be used with the packaging system of the invention.
Figure 6B:
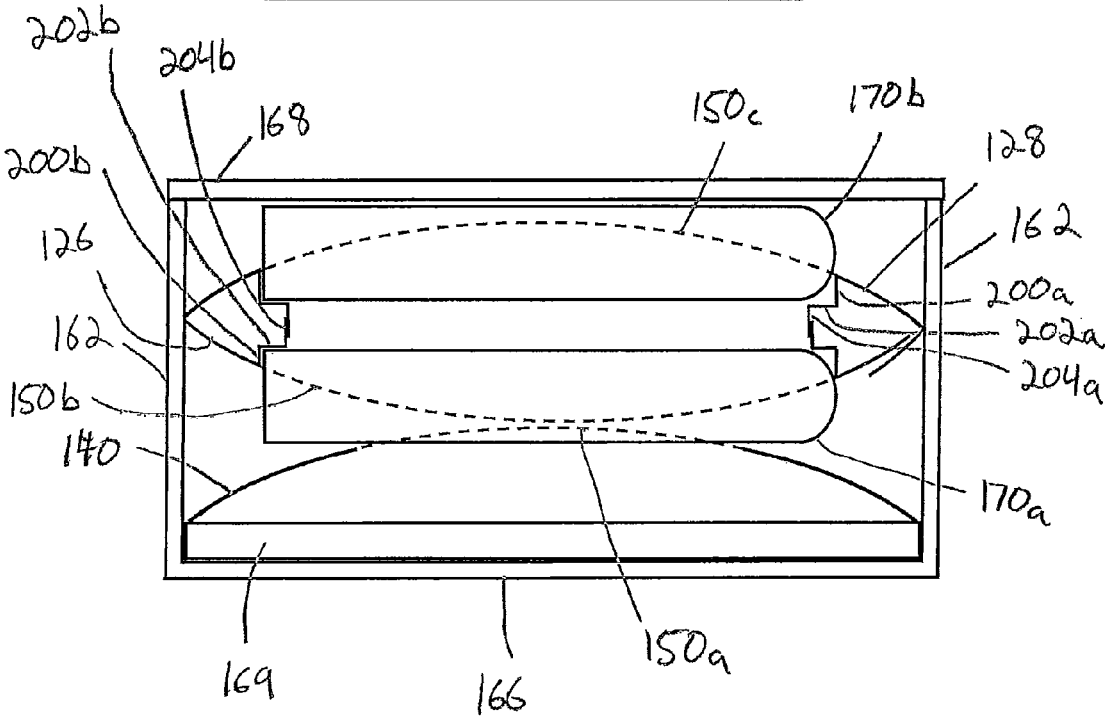
FIG. 6B is a side cross-sectional view of the supports of FIGS. 4A and 4B disposed in a box with cigars supported by the supports.

Referring to FIGS. 6A and 6B, supports 120 and 140 are adapted to support a cigar 170 of the type having a "straight body," commonly referred to as a "parejo" shape type cigar. The ends 172 (excluding the curved end wall) and the intermediate section 174 of cigar 170 are the same width.

Support 140 is inserted in box 160 in a similar fashion to support 40, as described above. Support 120 is folded along fold lines 122 and 124 to define upper portion 128, lower portion 126, and tab 130 and is inserted in box 160 in a similar fashion to support 20, as described above. After support 140 is inserted into box 160, cigars 170*a* are inserted into the elongate holes 150*a* in support 140. Support 120 is then inserted into the box 160 until lower portion 126 of support 120 rests on support 140 and panels 200*b* and 202*b* of support 120 engage cigar 170*a*. Cigar 170*b* is then inserted in holes 150*c* and seated by panels 200*a* and 202*a* of tabs 190*a* of support 120.

As can be seen in FIG. 6B, the elongate holes 150 in supports 120 and 140 are sized such that the intermediate sections 174 of the cigars are partially recessed into the holes 150. Since the intermediate sections 174 of the cigars 170 are recessed into the elongate holes 150, the supports 120 and 140 restrict side-to-side movement of the cigars. Since the cigars 170 are straight bodied, the tabs 190 are used to restrict end-to-end movement of the cigars 170. The panels 200 restrict end-to-end movement of the cigars 170. In addition to being restricted from side-to-side and end-to-end movement, cigars 170*a* are restricted from up and down movement because they are seated between supports 120 and 140 and are seated by collars 156 of support 140 from below and seated by panels 202*b* of tabs 190*b* of support 120 from above. Cigars 170*b* are restricted from up and down movement because they are seated from below by panels 202*a* of tabs 190*a* of the upper portion 128 of support 120 from above of are restricted from upward movement by lid 168 of the cigar box 160.

In this arrangement, support 140 is supported by the sidewalls 162 and bottom wall 166 of the box 160. Cigar 170*a* is supported vertically from below by support 140. Support 120 is supported by the sidewalls 162 and by support 140 as it rests on support 140. Panels 204*b* of tabs 190*b* of the lower portion 126 of the support 120 are supported by cigar 170*a* because panels 202*b* rest on cigar 170*a*. Cigar 170*b* is seated by panels 202*a* of the upper portion 128 of support 120. At least a portion of the downward vertical load of cigar 170*b* is transferred through panel 204*a* of tab 190*a* to panel 204*b* of tab 190*b*, the tabs 190*a* and 190*b* being engaged by their respective slits 198*a* and 198*b*. Thus, the load of cigar 170*b* is transferred through tab 190*a* to tab 190*b*, then from tab 190*b* to the cigar 170*a*, the load being further transferred through cigar 170*a* to support 140 and then to the sidewalls 162 and bottom wall 166 of the cigar box 160. Thus, the cigar box 160, supports 120 and 140, the tabs 190, and the cigars 170 form an interlocking structure that is self supporting and securely restricts movement of the cigars 170 to protect them during transport and handling.

As can be seen in FIG. 6B, the cigars 170 are slightly more recessed into the holes 150 of support 120 because of the position of the tabs 190. Accordingly, the cigars 170 will sit lower within a cigar box 160. Thus, there would be a gap between the lid 168 and the cigars, which could allow some movement of the cigars. An optional shim 169 may be inserted into the bottom of the box 160 to raise the level the of cigars 170 in the box 160, reducing the gap between the lid 168 and the cigars 170. This eliminates the need to change the dimensions of the box 160 to accommodate support 120 when parejo cigars are being packaged. Thus, box 60 and 160 can be the same dimensions and the same box can be used whether perfecto or parejo type cigars are being packaged. The shim 169 can be made from wood or folded paper card stock, for example.

The invention is described in detail with reference to a particular embodiments thereof, but the scope of the invention is to be gauged by the claims that follow and also by those modifications that provide equivalent features to those that are claimed as such modifications are still within the spirit and scope of the invention.

What is claimed is:

1. A cigar package for seating a plurality of elongate cigars, each cigar having end sections separated by an intermediate section and having a length, comprising:

a box having an interior defined by a bottom wall and sidewalls, including a first set of sidewalls spaced by a distance d;

a support disposed within the box and having two sides spaced by a distance D that engage the first set of sidewalls, the support defining a plurality of elongate holes having ends, wherein the support assumes an arch when disposed in the box; and a plurality of pairs of spaced collars, each pair of collars being defined by the ends of each of the elongate holes and being sized to seat the end sections of the cigar; wherein the support has an upper portion and a lower portion, the plurality of elongate holes being defined in each of the upper and lower portions of the support, wherein the upper portion of the support assumes a concave arch and the lower portion of the support assumes a convex arch when disposed in the box.

2. A cigar package of claim 1, wherein the support includes a first fold that defines the upper and lower portions.

3. A cigar package of claim 2, wherein the upper portion includes a flap defined by a second fold, the flap overlapping an area of the lower portion and being sized to seat an edge of the lower portion.

4. A cigar package of claim 1, wherein the distance d is less than the distance D.

5. A cigar package of claim 1, wherein the support is a sheet material.

6. A cigar package of claim 5, wherein the support is a paper card stock.

7. A cigar package of claim 6, wherein the support is recyclable or biodegradable.

8. A cigar package of claim 1, wherein the support includes indicia.

9. A cigar package for seating a plurality of elongate cigars, each cigar having end sections separated by an intermediate section and having a length, comprising:

a box having an interior defined by a bottom wall and sidewalls, including a first set of sidewalls spaced by a distance d;

first and second supports disposed within the box, each support having a first portion and two sides spaced by a distance D that engage the first set of sidewalls, the first portion of each support defining a plurality of elongate holes having ends, wherein the first portion of each support assumes a concave arch when disposed in the box, the second support further including a second portion defining a plurality of elongate holes having ends, wherein the second portion assumes a convex arch when disposed in the box; and a plurality of pairs of spaced collars, each pair of collars being defined by the ends of each of the elongate holes and being sized to seat the end sections of the cigar.

10. A cigar package of claim 9, wherein a first set of cigars is received by the collars of the first portion of the first support, the second support being positioned relative to the first support so that the collars of the second portion of the second support engage the first set of cigars, and a second set of cigars is received by the collars of the first portion of the second support.

11. A cigar package of claim 9, wherein the second support includes a first fold that defines the first and second portions of the second support.

12. A cigar package of claim 11, wherein the first portion of the second support includes a flap defined by a second fold, the flap overlapping an area of the second portion and being sized to seat an edge of the second portion.

13. A cigar package of claim 9, wherein the distance d is less than the distance D.

14. A cigar package of claim 9, wherein the supports are a sheet material.

15. A cigar package of claim 14, wherein the supports are recyclable or biodegradable.

16. A cigar package of claim 9, wherein the supports include indicia.

* * * * *